US010188919B2

(12) United States Patent
Williams

(10) Patent No.: US 10,188,919 B2
(45) Date of Patent: Jan. 29, 2019

(54) GOLF TOWEL

(71) Applicant: Lee R. Williams, W. Bloomfield, MI (US)

(72) Inventor: Lee R. Williams, W. Bloomfield, MI (US)

( * ) Notice: Subject to any disclaimer, the term of this patent is extended or adjusted under 35 U.S.C. 154(b) by 145 days.

(21) Appl. No.: 15/463,030

(22) Filed: Mar. 20, 2017

(65) Prior Publication Data

US 2017/0266523 A1 Sep. 21, 2017

Related U.S. Application Data

(60) Provisional application No. 62/310,858, filed on Mar. 21, 2016.

(51) Int. Cl.

| | |
|---|---|
| ***A47L 13/12*** | (2006.01) |
| ***A47L 13/16*** | (2006.01) |
| ***A63B 47/04*** | (2006.01) |
| ***A63B 57/60*** | (2015.01) |
| ***A63B 57/00*** | (2015.01) |

(52) U.S. Cl.

CPC ..... *A63B 57/00* (2013.01); *A47L 13/12* (2013.01); *A47L 13/16* (2013.01); *A63B 47/04* (2013.01); *A63B 57/60* (2015.10)

(58) Field of Classification Search

CPC ..... A47L 13/12; A47L 13/16; A63B 47/04; A63B 57/60

See application file for complete search history.

(56) References Cited

U.S. PATENT DOCUMENTS

| | | | | |
|---|---|---|---|---|
| 4,516,616 | A * | 5/1985 | Fesler | A63B 57/00 150/154 |
| 5,075,918 | A | 12/1991 | Zeltner | |
| 5,331,705 | A | 7/1994 | Melov | |
| 5,761,761 | A | 6/1998 | An | |
| 6,256,840 | B1 * | 7/2001 | Elliott | A63B 57/60 24/3.11 |
| 7,219,388 | B2 * | 5/2007 | Hale | A47K 7/02 15/209.1 |
| 8,516,643 | B1 | 8/2013 | Salzman | |
| 8,756,742 | B1 | 6/2014 | Salzman | |
| 8,851,090 | B2 | 10/2014 | Bradshaw | |
| 9,162,125 | B1 * | 10/2015 | McBryde | A46B 5/0008 |
| 2015/0128372 | A1 * | 5/2015 | Quelle | A47L 13/12 15/229.11 |

FOREIGN PATENT DOCUMENTS

| | | |
|---|---|---|
| GB | 2368536 A | 5/2002 |
| WO | WO-00/67855 | 12/2000 |

* cited by examiner

*Primary Examiner* — Randall Chin
(74) *Attorney, Agent, or Firm* — The Weintraub Group, P.L.C.

(57) ABSTRACT

A golf towel including a towel body, the towel body having both a first abrasive portion and a second abrasive portion for cleaning the dimples on a golf ball and the grooves in a golf club head, respectively. The first abrasive portion includes a plurality of nubs projecting outwardly therefrom and corresponding to dimples on a golf ball. The first abrasive portion may include a bowl-shaped cavity for at least partially enveloping a golf ball when seated therein. The second abrasive portion includes a plurality of linearly arranged mounds projecting outwardly therefrom in a substantially parallel manner. The plurality of mounts is arranged to clean individual and corresponding grooves formed in golf club head.

16 Claims, 3 Drawing Sheets

GOLF TOWEL

CROSS-REFERENCE TO RELATED APPLICATION

This application is a completion application which claims the priority benefit of U.S. Provisional Patent Application Ser. No. 62/310,858, filed Mar. 21, 2016, for "Golf Towel," the entire disclosure of which, including the drawing, is hereby incorporated by reference.

BACKGROUND OF THE INVENTION

1. Field of the Invention

The present invention pertains to golf towels. More particularly, the present invention concerns golf towels for cleaning golf balls and golf club heads. Even more particularly, the present invention relates to golf towels having a plurality of cleaning surfaces each configured to specifically clean either dimples of a golf ball or grooves formed within the golf club head.

2. Description of Related Art

It is well known that during the course of playing a round of golf, equipment such as golf clubs and golf balls will get increasingly dirty from use, thus affecting gameplay.

Golf clubs are precisely crafted pieces of equipment with specifically configured grooves formed in the head of the golf club. These grooves serve a specific purpose in controlling the amount of friction on the golf ball and, thus, the amount of spin that the ball exhibits.

As the object of an ideal golf swing is to strike the ball such that the club comes into close contact with the ground, doing so causes the golf club head to pick up debris such as grass and dirt that becomes embedded in the club's grooves until it is cleaned. When debris becomes engrained in these grooves during gameplay, it can substantially and undesirably affect the movement of the golf ball.

Similarly, a golf ball is specifically manufactured to have anywhere from 300 to 500 dimples, each having a diameter of approximately 4 mm, formed in the surface of the golf ball. The dimples serve a function of controlling drag and flight of the golf ball after being struck by the head of the golf club. As is typically the case, golf balls oftentimes end up in either a bunker or a muddy fairway. In doing so, the dimples of the golf ball become filled with debris from these hazards, which greatly affects the flight of the ball.

The fact that golf balls and clubs need to be cleaned periodically during gameplay is a well-known fact and a number of potential solutions have been presented. One of these potential solutions is disclosed in U.S. Pat. No. 8,851,090 to Bradshaw which teaches a golf towel having a weaved portion with a rough surface for cleaning the dirt off a golf ball or a golf club head. The towel further comprises a soft terry cloth portion for polishing the golf club head after removing the dirt.

A number of similar golf towels have been disclosed in U.S. Pat. No. 8,756,742 to Salzman, U.S. Pat. No. 5,761,761 to An, U.S. Pat. No. 5,331,705 to Melov, and U.S. Pat. No. 5,075,918 to Zeltner. Each of the above references disclose a towel, particularly used in cleaning golf balls and golf club heads, including an abrasive surface on a portion of the towel.

While each of the above references teach a device that can clean golf equipment during play, the references fail to disclose the use of differently configured or shaped abrasives to suit the differences in geometries between the dimples on a golf ball and the grooves in the head of a golf club. While a single abrasive may satisfactorily clean the crevices in the dimples and grooves, an abrasive matching the geometry of each of the crevices and surfaces of the equipment would more efficiently remove any embedded debris.

Additionally, while each of the devices disclosed in the above references are suitable for the uses and problems they intend to solve, there is an ongoing need for improvements in a golf towel, such as one with distinguishing portions specifically configured to clean the dimples of a golf ball and grooves in a golf club's head.

It is to this to which the present invention is directed.

SUMMARY OF THE INVENTION

The present invention provides a golf towel comprising: (a) a fabric towel body having a first side and a second side; (b) a first abrasive portion secured to one side of the towel body and comprising a plurality of nubs projecting outwardly therefrom, each one of the plurality of nubs comprising an abrasive material that nests within an associated dimple on a golf ball; and (c) a second abrasive portion secured to a side of the towel body and comprising a plurality of mounds projecting outwardly therefrom, the plurality of mounds being arranged in a plurality of linear and parallel rows, each one of the plurality of mounds comprising an abrasive material that nests within an associated groove on a golf club head.

Preferably, the first abrasive portion comprises a concave bowl-shaped cavity for at least partially enveloping a golf ball during cleaning. The plurality of nubs is disposed within the cavity and project towards a center portion thereof.

Each one of the plurality of rows on the second abrasive portion may comprise either a single elongated mound or, alternatively, a plurality of individual mounds arranged in a linear manner.

Additionally, a third abrasive portion may be disposed on the towel body similar to that of the second abrasive portion. Where the second abrasive portion is desired to clean a right-handed handed golf club head, the third abrasive portion is configured to clean a left-handed golf club head.

Preferably, the golf towel further comprises an opening formed in the towel body. The opening allows for securing means for attaching, such as a traditional golf clip or the like, the golf towel to a golf bag.

For a better understanding of the present invention, reference is made to the accompanying drawing and detailed description. In the drawing, like reference characters refer to like parts through the several views, in which:

DETAILED DESCRIPTION OF THE INVENTION

Figure 1:
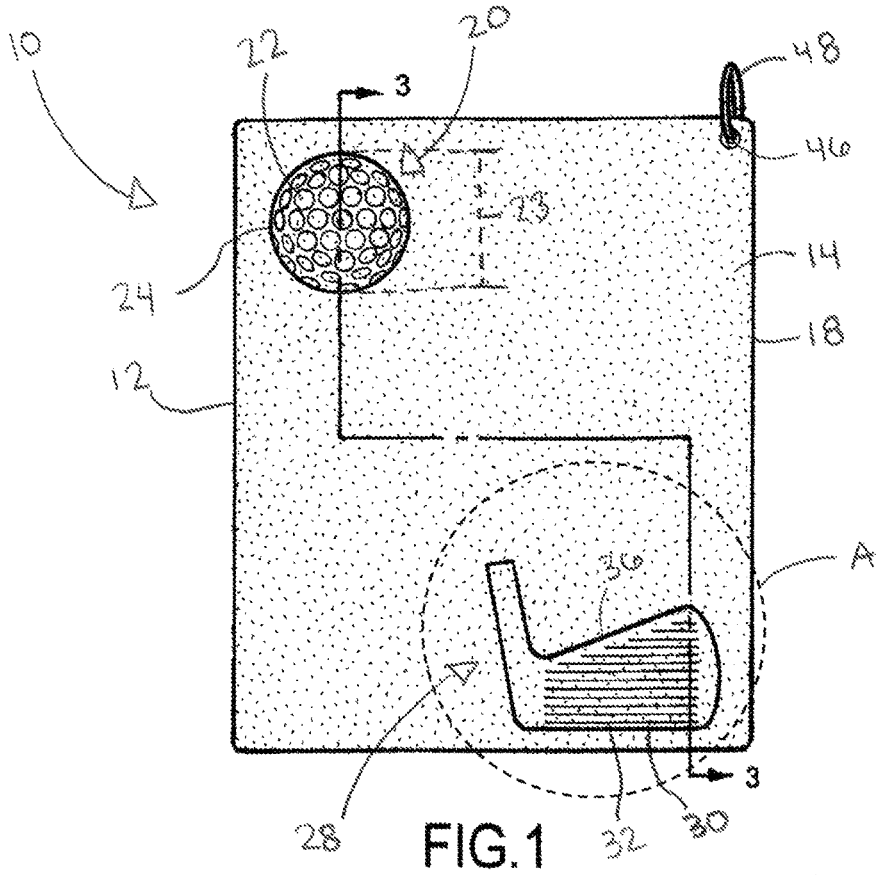
FIG. 1 is a front view of a golf towel in accordance with the present invention.

Turning now to the drawing, FIGS. 1-7 show a golf towel 10 for cleaning golf equipment, particularly a golf ball and a golf club head.

The golf towel 10 of the present invention generally includes a towel body 12, preferably, made of a single piece of soft fabric, such as cotton terry cloth, a polyester or a polyamide microfiber, or the like. The golf towel 10 has a first side 14, a second side 16, and a perimetral edge 18. The golf towel 10 further comprises a first abrasive portion 20 and a second abrasive portion 28. It is to be understood that the first and second abrasive portions 20, 28 may be either extensions of the towel body 12, itself, or, alternatively, the first and second abrasive portions 20, 28 may comprise additional pieces of fabric secured within associated cutouts or substantially circular openings formed in the towel body 12 by any suitable method such as sewing or the like.

Although the first abrasive portion 20 is shown as being visible from the first side 14 of the towel body 12, it can be arranged on either the first side 14 or the second side 16. Preferably, and as shown in FIG. 1, the first abrasive portion 20 is visible from the first side 14 of the towel body 12 and disposed proximate the edge 18. While it is to be understood that the first abrasive portion 20 can comprise any shape, it is preferred that the first abrasive portion 20 has a circumference 24 corresponding to the outline of a golf ball. Preferably, the circumference 24 has a diameter 23 of at least that of the diameter of a golf ball. When the first abrasive portion 20 is provided within an opening formed in the golf towel 10, the opening is defined by the circumference 24.

Figure 3:
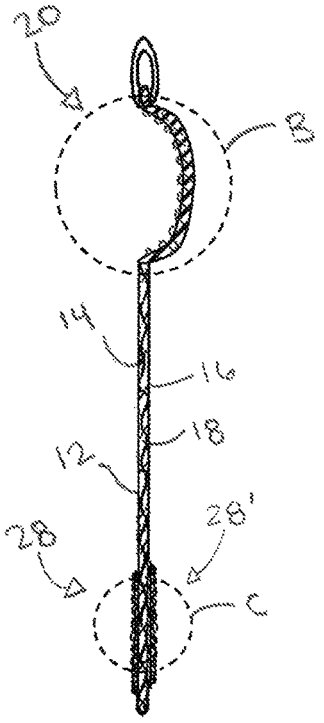
FIG. 3 is a cross-sectional view taken along line 3-3 of FIG. 1.
Figure 4:
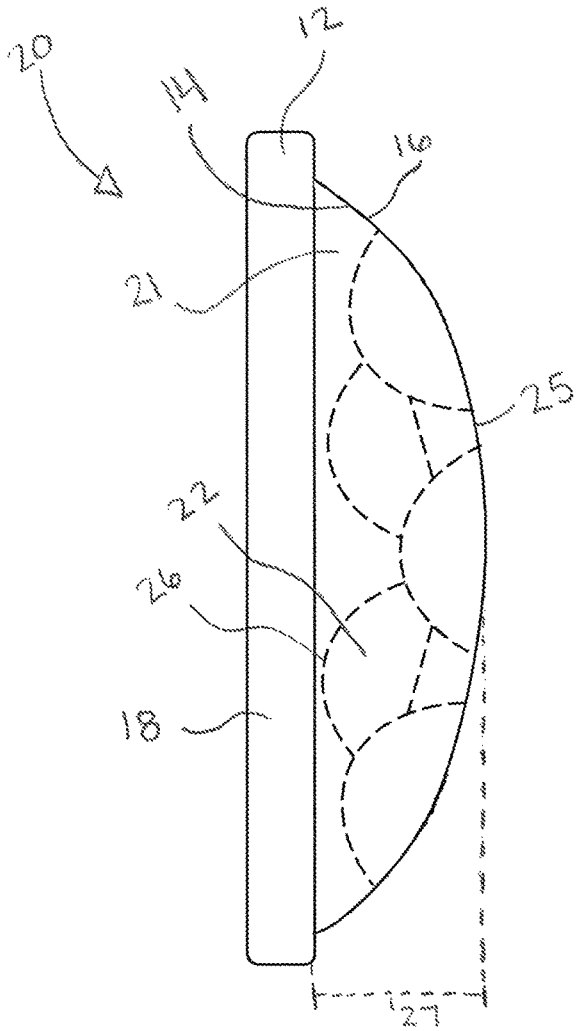
FIG. 4 is an enlarged detailed side view of the plurality of nubs as shown in circle B in FIG. 3.

As shown in FIGS. 1, 3 and 4, the first abrasive portion 20 comprises a concave bowl-shaped cavity 21, having a circumference 25 and a depth 27, secured to the towel body 12 at the circumference 24.

The cavity 21 removably houses a golf ball during the cleaning process. The circumference 25 of the cavity 21 is larger than the diameter 23 of the circumference 24. It is to be understood that the diameter 23 and the circumference 25 of the cavity 21 cooperate to define the depth 27 of the cavity 21. Either decreasing the diameter 23 or increasing the circumference 25 of the cavity 21 results in a cavity 21 having a greater depth 27. Similarly, either increasing the diameter 23 or decreasing the circumference 25 of the cavity 21 so that the diameter 23 and circumference 25 are almost equal to one another would render the cavity 21 substantially flat. Preferably, the first abrasive portion 20 has a cavity 21 deep enough that it can completely, or at least partially, envelop a portion of the surface area of a golf ball during cleaning.

As shown in detail in FIG. 4, the first abrasive portion 20 comprises a plurality of nubs 22 disposed within the cavity 21 and protruding toward a center thereof. The plurality of nubs 22 are substantially hemispherical having a curvilinear abrasive surface 26. Each one of the plurality of nubs 22 has a diameter substantially equal to that of the dimples in a golf ball such that each nub nests within a corresponding dimple. The dimples on a golf ball range in size having a diameter of approximately 0.14 inches to about 0.17 inches. Therefore, the plurality of nubs 22, accordingly, have a matching diameter ranging from approximately about 0.14 inches to about 0.17 inches as well. Preferably, the height of each one of the nubs 22 exceeds the depth of the dimples, thus resulting in an abrasive cleaning within the entire interior and surface area of the golf ball dimple.

The arrangement or spacing of the plurality of nubs 22 on the first abrasive portion 20 preferably corresponds to the configuration of dimples on a golf ball wherein each one of the plurality of nubs 22 can nest within the dimples on a golf ball simultaneously during cleaning.

The plurality of nubs 22 can either be integral extensions of the first abrasive portion 20 having a varying height or, alternatively, a separate abrasive material, such as a bristle brush material. If the nubs 22 are separate materials, they can be secured to the first abrasive portion 20 by any suitable means, such as sewing, gluing, or the like.

As noted above, the fabric comprising the cavity 21 is may be the same as that of the towel body 12 and secured to the circumference 24 of the first abrasive portion 20 using any suitable means such as sewing, adhesive, or the like. Alternatively, the cavity 21 can be integrally formed with the circumference 24 of the first abrasive portion 20 such that the towel body 12 is a continuous extension throughout.

Figure 2:
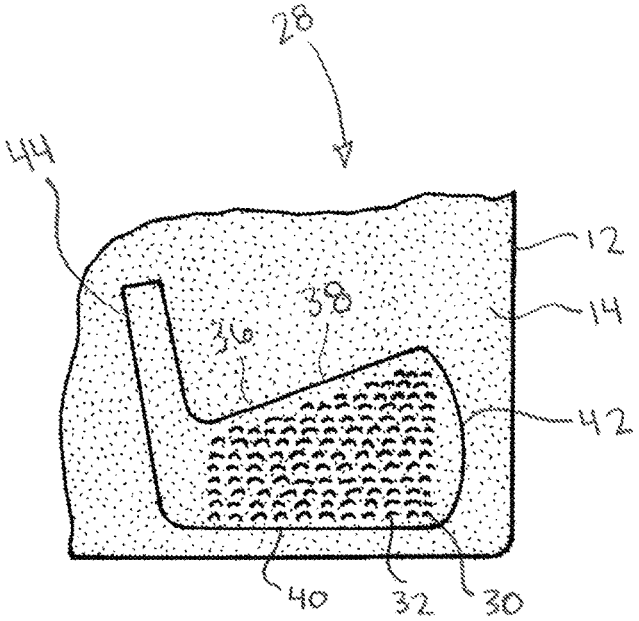
FIG. 2 is an enlarged detailed front view of the golf towel as shown in circle A in FIG. 1.
Figure 5:
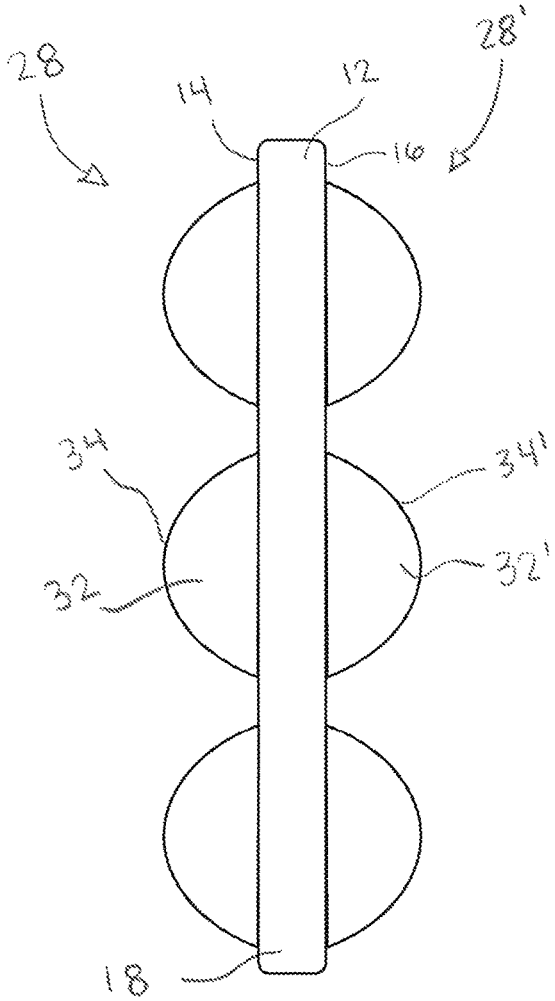
FIG. 5 is an enlarged detailed side view of the plurality of mounds as shown in circle C in FIG. 3.

As shown in FIGS. 1, 2, and 5, the second abrasive portion 28 is disposed on the first side 14 of the towel body 12. Similar to that of the first abrasive portion 20, the second abrasive portion 28 may be an extension of the towel body 12 and formed from a single piece of fabric. Alternatively, a separate piece of fabric may be secured to the first side 14 of the towel body 12 or atop the towel body 12, itself, over a substantially circular opening formed therein.

The second abrasive portion 28 comprises a plurality of linear elongated rows 30. Each one of the plurality of rows 30 comprises at least one mound 32, thus forming a plurality of mounds 32 arranged in a substantially linear and parallel manner. Each one of the plurality of mounds 32 has a depth dimensioned to nest within a respective groove formed in a gold club head. Each one of the plurality of mounds 32 comprises a curvilinear abrasive surface 34 radiating outwardly from the first side 14 of the towel body 12 within the second abrasive portion 28. Moreover, the depth of each one of the plurality of mounds 32 has a depth at least equal to the depth of a groove on a golf club head. Preferably, the depth of each one of the plurality of mounds 32 exceeds the depth of the grooves, thus resulting in an abrasive cleaning within the entire interior of the groove.

The plurality of rows 30 is arranged in a configuration corresponding to the configuration of grooves found on the head of a golf club. Thus, when the head of a golf club is positioned over the second abrasive portion 28, the plurality of mounds 32 should correspond to and nest within the grooves of the golf club head.

The mounds 32, similar to that of the plurality of nubs 22, can either be extensions of the towel body 12 having a varying height protruding outwardly from the towel body 12 or, alternatively, a separate abrasive material, such as a bristle brush material. If the mounds 32 are separate from that of the towel body 12, they can be secured to the towel body 12 by any suitable means, such as sewing, gluing, or the like.

In a first embodiment of the present invention, each of the rows 30 comprises only a single elongated mound 32.

In an alternative embodiment, each of the rows 30 comprises a plurality of smaller, individual mounds 32.

Further, while it is to be understood that the second abrasive portion 28 can have a variety of configurations, it is preferred that the second abrasive portion 28 includes an outline 36 matching that of a golf club head. The outline 36 of the second abrasive portion 28, therefore, comprises an upper edge 38 and a lower edge 40. The upper and lower edges 38, 40 are interconnected by an arc 42 at a first end of each of the upper and lower edges 38, 40. The ends of the upper and lower edges 38, 40 opposite the arc 42 are interconnected by an upwardly extending extension 44 matching that of the hosel of a golf club shaft.

As shown in FIGS. 1 and 2, the outline 36 and the configuration of mounds 32 form the second abrasive portion 28 and a cleaning surface corresponding to right-handed golf clubs. Where the golfer uses a left-handed golf club, the second abrasive portion 28 may be modified or, alternatively, a third abrasive portion 28' may be included.

The third abrasive portion 28' exhibits a similar structure to that of the second abrasive portion 28, but reflected over a vertical axis. Preferably, the third abrasive portion 28' may be disposed on the opposite side of the towel body 12 as that of the second abrasive portion 28. Alternatively, the third abrasive portion 28' may be integrally formed with the second abrasive portion 28 instead of being a separate piece of fabric. This is possible when the second abrasive portion 28 is secured about an opening formed in the towel body 12 and accessible from the opposite side.

Figure 6:
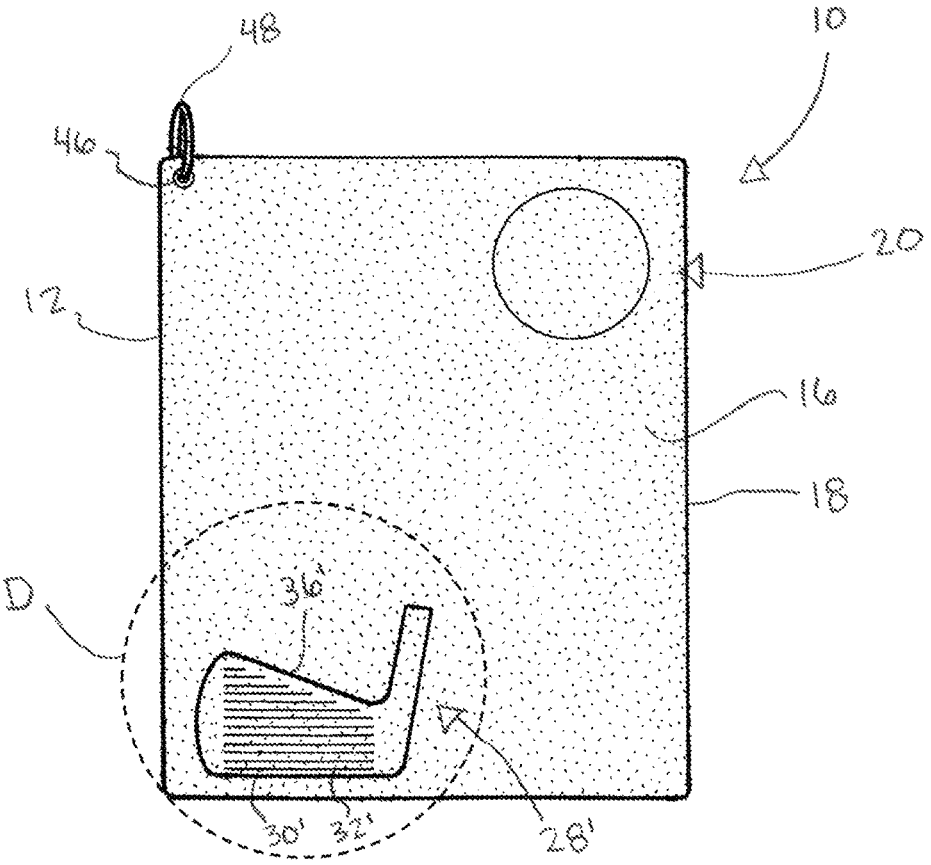
FIG. 6 is a rear view of the golf towel as seen opposite that of FIG. 1.
Figure 7:
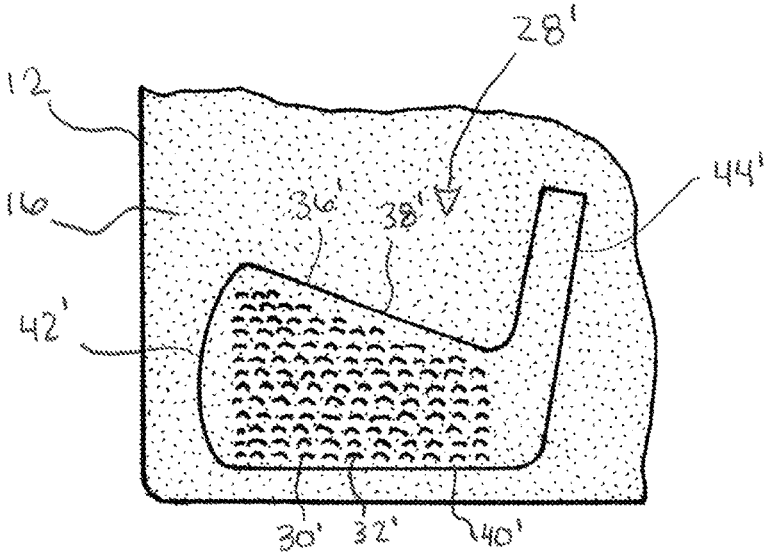
FIG. 7 is an enlarged detailed back view of the golf towel as shown in circle D in FIG. 6.

As shown in FIGS. 5-7, an outline 36' of the third abrasive portion 28' comprises an upper edge 38' and a lower edge 40'. The upper and lower edges 38', 40' are interconnected by an arc 42' at a first end of each of the upper and lower edges 38', 40'. The ends of the upper and lower edges 38', 40' opposite the arc 42' are interconnected by an upwardly extending extension 44' matching that of a golf club shaft.

Within the outline 36', the third abrasive portion 28' comprises a plurality of linear and elongated rows 30'. Each one of the plurality of rows 30' comprises at least one mound 32' similar to that of the second abrasive portion 28. It is to be appreciated that the outline 36' and the mounds 32' within the third abrasive portion 28' is optimal for golfers desiring to clean left-handed clubs.

As shown in FIG. 1, the golf towel 10 of the present invention, preferably, comprises an opening 46 formed in the towel body 12. Means for attaching 48, such as a ring or towel clip well known to those of ordinary skill in the art, may be inserted into the opening 46 for removably attaching the golf towel 10 to a golf bag or the like. Preferably, the opening 46 is distally located from both the first abrasive portion 20 and the second abrasive portion 28.

In use, the user positions a dirty golf ball within the cavity 21 of the first abrasive portion 20 such that the plurality of nubs 22 nest within the dimples of the golf ball. The user then wraps the first abrasive portion 20 around a portion of the surface of the golf ball and rotates the golf towel 10 and/or golf ball until satisfied.

In cleaning a dirty golf club head, the user places the head of the golf club within the confines of the outline 36 of the second abrasive portion 28 such that the plurality of mounds 32 nest within corresponding grooves formed in the golf club head. The user then traverses the second abrasive portion 28 and/or golf club head from side to side over the surface of the golf club head until satisfied.

The remaining unused areas of the towel body 12 remains available to clean surfaces other than a golf ball or golf club head. Alternatively, the third abrasive portion 28' may be employed if it is more suitable in light of the design of the golf club.

Further, while it is to be understood that the first abrasive portion 20, the second abrasive portion 28, and the third abrasive portion 28' can be secured to or formed within either the first or second side 14, 16 of the towel body 12, it is preferred that, when the second abrasive portion 28 and third abrasive portion 28' are accessible from opposite sides of the towel body 12. Moreover, it is preferred that the first abrasive portion 20 be located at a distal end of the towel body 12 from either the second or third abrasive portion 28, 28' from which it shares a side of the towel body 12. Further, it is to be understood that there is no restriction that the second abrasive portion 28 and the third abrasive portion 28' be limited to use with either right or left-handed golf clubs.

From the above, it is to be appreciated that defined herein is a new and unique golf towel having at least two abrasive surfaces for cleaning a golf ball and a golf club. Each of the abrasive surfaces are specifically dimensioned to clean either the surface and dimples of the golf ball or the face and grooves of the golf club.

LIST OF REFERENCE NUMERALS

10 Golf towel
12 Towel body
14 First side
16 Second side
18 Perimetral edge
20 First abrasive portion
21 Cavity of first abrasive portion
22 Nubs
23 Diameter of circumference
24 Circumference of first abrasive portion
25 Circumference of cavity
26 Abrasive surface of nubs
27 Depth of cavity
28 Second abrasive portion
28' Third abrasive portion
30 Row
30' Row
32 Mound
32' Mound
34 Abrasive surface of mound
36 Outline
36' Outline
38 Upper edge of outline
38' Upper edge of outline
40 Lower edge of outline
40' Lower edge of outline
42 Arc of outline
42' Arc of outline
44 Extension of outline
44' Extension of outline
46 Opening
48 Means for attaching

Having thus described the invention, what is claimed is:

1. A golf towel comprising:

(a) a fabric towel body having a first side and a second side;

(b) a first abrasive portion secured to one side of the towel body and comprising a plurality of nubs projecting outwardly therefrom, each one of the plurality of nubs comprising an abrasive material that nests within an associated dimple on a golf ball; and (c) a second abrasive portion secured to a side of the towel body and comprising a plurality of mounds projecting outwardly therefrom, the plurality of mounds being arranged in a plurality of linear and parallel rows, each one of the plurality of mounds comprising an abrasive material that nests within an associated groove on a golf club head.

2. The golf towel of claim 1 wherein the first and second abrasive portions are integrally formed with the towel body and formed from a single piece of fabric.

3. The golf towel of claim 1 wherein the towel body further comprises:

(a) a substantially circular opening formed within the towel body for accepting a golf ball, the opening having a diameter at least as large as that of a golf ball.

4. The golf towel of claim 3 wherein the first abrasive portion is a separate piece of fabric secured to the towel body about the opening formed therein, the first abrasive portion further comprising:

(a) a bowl-shaped cavity, the plurality of nubs disposed within the cavity and extending toward a center portion thereof; and wherein the cavity at least partially envelops a golf ball when seated within the cavity.

5. The golf towel of claim 4 wherein the first abrasive portion fully envelops a golf ball when seated within the cavity.

6. The golf towel of claim 1 wherein each one of the plurality of nubs is substantially hemispherical.

7. The golf towel of claim 1 wherein each one of the plurality of rows comprises a single elongated mound.

8. The golf towel of claim 1 wherein each one of the plurality of rows comprises a plurality of individual mounds being arranged linearly.

9. The golf towel of claim 8 wherein the second abrasive portion further comprises an outline of a right-handed golf club head.

10. The golf towel of claim 1 wherein the plurality of mounds corresponds to the grooves on of right-handed golf club head.

11. The golf towel of claim 1 further comprising an opening formed in the towel body for removably attaching the golf towel to a golf bag.

12. The golf towel of claim 1 wherein the fabric body is cotton terrycloth.

13. The golf towel of claim 1 wherein the plurality of nubs is formed from a bristle brush material.

14. The golf towel of claim 1 wherein the plurality of mounds is formed from a bristle brush material.

15. The golf towel of claim 14 wherein the third abrasive portion is disposed on a side of the towel body opposite the second abrasive portion.

16. The golf towel of claim 1 further comprising:

(a) a third abrasive portion disposed on the towel body comprising a plurality of mounds projecting outwardly therefrom, the plurality of mounds being arranged in a plurality of linear and parallel rows corresponding to a configuration of grooves on a left-handed golf club head.

* * * * *